US007101114B1

(12) United States Patent
Waters, Jr.

(10) Patent No.: US 7,101,114 B1
(45) Date of Patent: Sep. 5, 2006

(54) STORM DRAIN SYSTEM AND METHOD

(76) Inventor: Louis A. Waters, Jr., 4522 Teas St., Bellaire, TX (US) 77401

( * ) Notice: Subject to any disclaimer, the term of this patent is extended or adjusted under 35 U.S.C. 154(b) by 0 days.

(21) Appl. No.: 11/175,873

(22) Filed: Jul. 6, 2005

(51) Int. Cl.
*E02B 11/00* (2006.01)

(52) U.S. Cl. ..... 405/41; 405/39; 405/40

(58) Field of Classification Search ..... 405/36, 405/39, 40, 41
See application file for complete search history.

(56) References Cited

U.S. PATENT DOCUMENTS 6,062,767 A * 5/2000 Kizhnerman et al. ..... 405/39

* cited by examiner

*Primary Examiner*—Frederick L. Lagman

(74) *Attorney, Agent, or Firm*—Tim L. Burgess

(57) ABSTRACT

A storm drain system is provided to prevent rising water from flowing substantially vertically out of a storm drain inlet. The storm drain system comprises a seat generally horizontally mounted within a chamber and a moveable buoyant door assembly responsive to rising water in the chamber to float upwardly to engage the seat to thereby prevent water flowing upwardly out of the storm drain inlet. A support frame may be mounted along a flow passageway leading to the storm drain gating such that the seat and the buoyant door assembly is mounted to or integral with the support frame. In an embodiment, one or more pivot or hinge mountings secure the buoyant door assembly pivotally with respect to the drain support.

44 Claims, 3 Drawing Sheets

STORM DRAIN SYSTEM AND METHOD

BACKGROUND OF THE INVENTION

This invention relates generally to the field of regulating flood water and more specifically to a system and method for preventing or delaying flooding which may be caused locally by rising water from within the storm water drain system itself.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged with certain features emphasized to facilitate an understanding of the invention.

DESCRIPTION OF PREFERRED EMBODIMENTS

Figure 2:
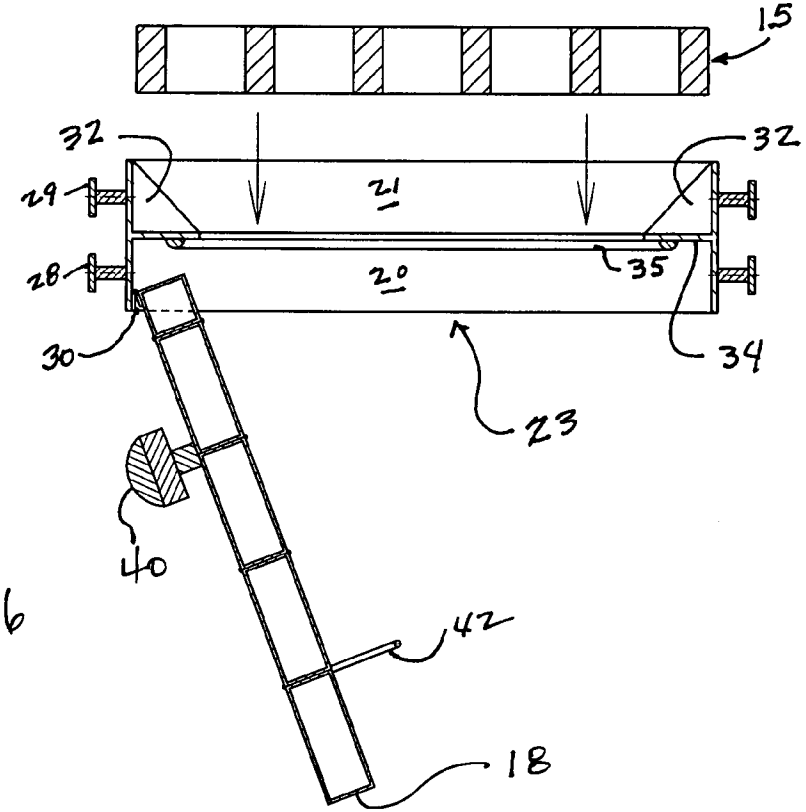
FIG. 2 is an elevational view of a storm drain assembly in accordance with one possible embodiment of the invention installable into a storm drain basin.

Descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Storm sewers typically comprise underground collector systems which receive surface water through surface level inlets that drain into subsurface receiving chambers that communicate in a lower portion with storm sewer conduits that empty under gravity flow, either directly, or indirectly through a system of typically ever larger collector conduits, to one or more outfalls pouring into open (to the sky) drainage channels or bodies of water. Open drainage channels into which outfalls pour typically include natural and constructed drainage ditches and natural streams, bayous and rivers; bodies of water into which outfalls pour typically include ponds, lakes or bays and constructed water impounds such retainage and holding ponds.

Depending on such non-limiting facts as the slope of a storm sewer system to outfall(s), the fill condition of the storm sewer and rate of exit at the outflow, a hydrostatic pressure head may develop from water in upstream collector conduits that may force water in surcharged downstream collector conduits out inlets of receiving chambers of conduits upstream of the outfall(s), causing or exacerbating sheeting flooding in the areas where the water is expelled.

Sometimes the rise of water retained in a flowing open drainage channel or rising body of water is so great that it submerges the outfall of a storm sewer system emptying into that drainage channel or body of water, that is, the elevation of water in the drainage channel or body of water rises higher than the distal portions of the storm sewer system emptying at the outfall. When this happens the hydrostatic pressure of the open drainage channel or body of water adjacent the outfall is greater than the hydrostatic pressure inside the sewer system at the outlet. This prevents flow from the outfall and surcharges the distal potions of the sewer system, the extent of surcharge up the length of the sewer system depending in part on how much higher the storm waters in the drainage channel or the body of water extend over the outfall. This hydrostatic pressure can pressurize enough of the more distal portions of the sewer system to expel water from inlets of their receiving chambers, causing flooding in the area of the backflow. The same problem can occur in locations where permanent dikes or temporary barriers protect areas inside the dike or barrier from water rising on the outside of the dike or barrier; a higher hydrostatic head of water on the outside of the dike or barrier can backflow water through the storm sewers that are supposed to empty on the outside of the dike or barrier, and the backflow can flood the area inside the dike or barrier.

The present invention provides means for limiting or delaying flooding at locations adjacent storm drains as might be caused by water backfowing from storm drain inlet chambers. Such inlet chambers may be located, for example, along freeways or streets, in residential subdivisions or business parks or medical centers, in yards of houses, in surface parking lots of shopping centers or factories, in athletic stadium field drains, in basement floors of structures such as parking garages with underground levels, in railroad or runway underpasses, or in other locations where sheeting surface water can be captured and flowed away by underground storm sewers. In lower areas or in areas adjacent an outfall or on the protected side of a dike or barrier, water backfowing in the drainage system may become a greater flooding threat than sheeting rain water even after the rain has stopped. Embodiments of the present invention provide means to limit flooding damage from backflowing storm water sewers.

Without limitation by description of potential particular embodiments or their uses or advantages, one possible embodiment provides a warning system to indicate that flooding is imminent whereupon measures can be taken to avoid flood damage where possible. Embodiments of the present invention can operate automatically. In one embodiment, basic operation requires no power, no human operators, and no sensors. Due to simplicity of construction, operation of embodiments of the present invention is highly reliable and is preferably controlled by buoyancy force power produced by rising water itself. As explained hereinafter, in possible embodiments the installed storm system of the present invention can be adjusted in height or position to provide a desired result which may vary from location to location. In yet another possible embodiment of the present invention, the storm system may be used with sensors to electronically send status information on rising waters in sewers as may be desired to operate warnings or closures of streets, highways and freeways, especially where flooding is imminent, thereby preventing pedestrians or motorists from being caught in rising water. Embodiments of the storm system of the present invention may be utilized to prevent or forestall or to warn about dangerous situations and could be utilized as a relatively inexpensive means to warn of, limit, or forestall the high costs of building or vehicular water damage or personal injury. Embodiments of the present invention may be relatively easily installed as a complete system secured to a single frame. Due to simplicity of operation, embodiments of the system may be relatively easily viewed by workers to ascertain that an embodiment is in working order. Operation is very simple but highly effective and reliable.

Figure 1:
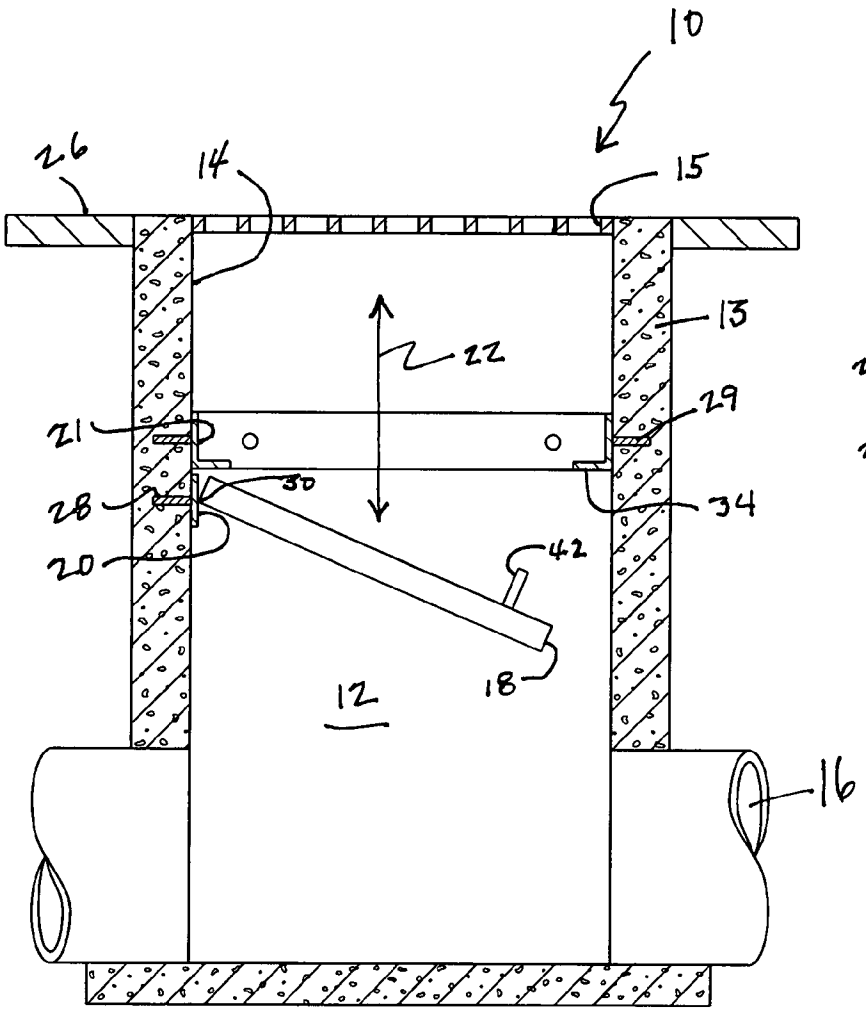
FIG. 1 is an elevational view of a storm drain system in accordance with one possible embodiment of the invention.
Figure 4:
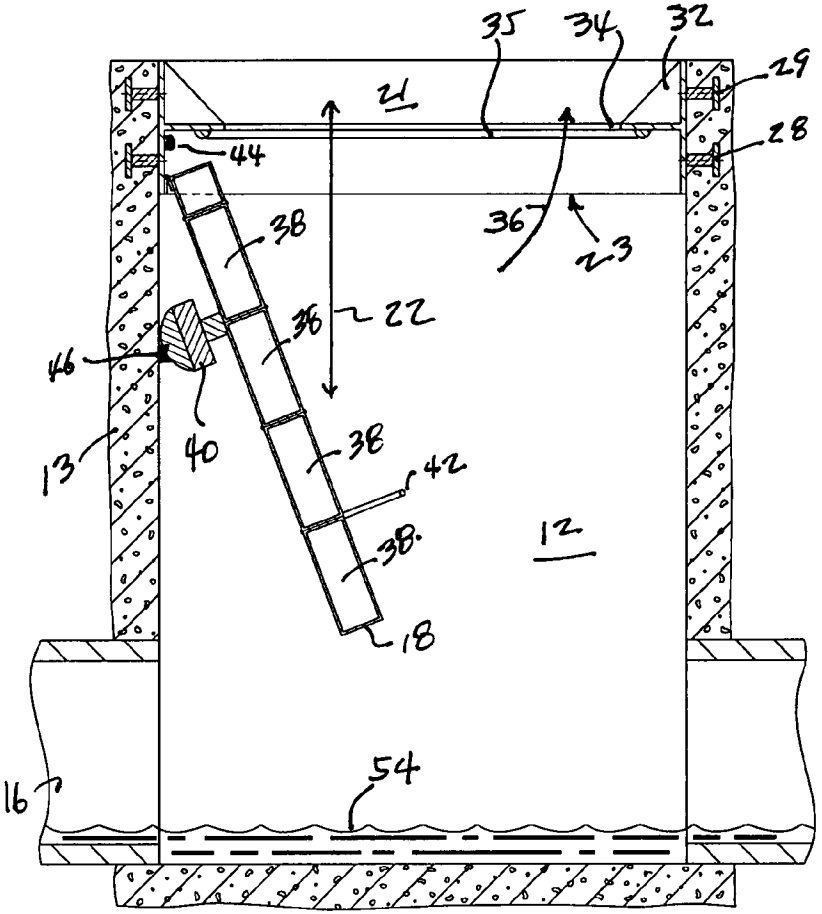
FIG. 4 is an elevational view of a storm drain system with a buoyant door assembly as positioned in absence of flood water in accord with one possible embodiment of the invention.
Figure 3:
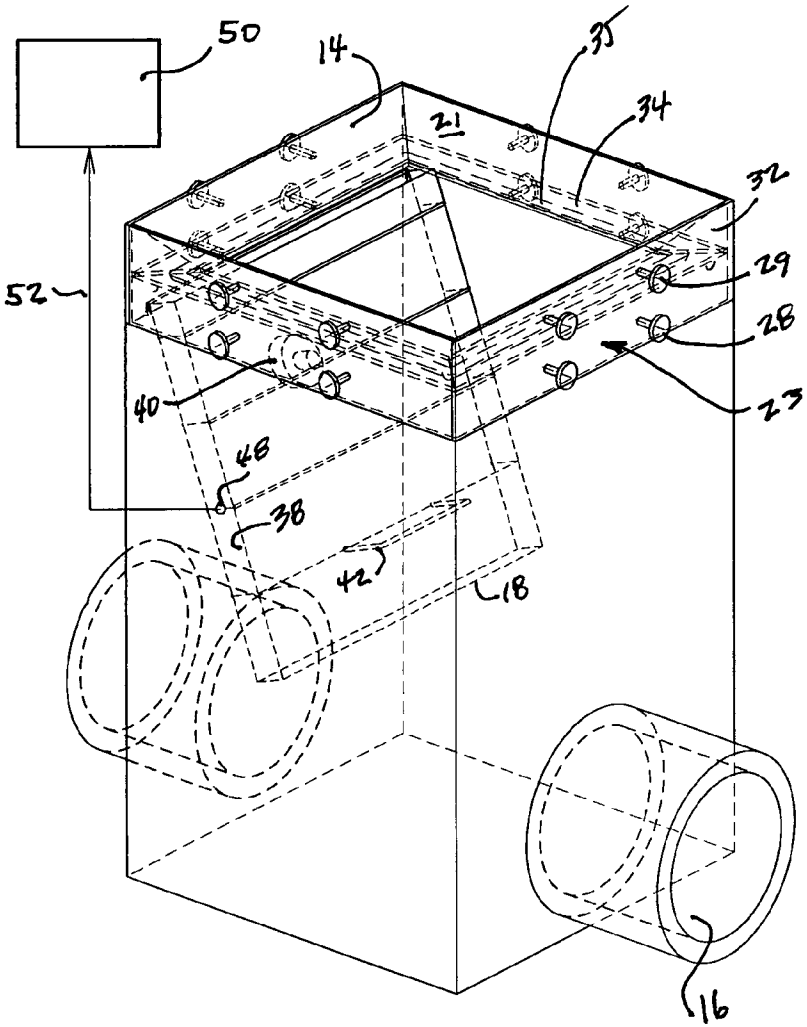
FIG. 3 is a perspective view of a storm drain system in accord with one possible embodiment of the invention.

Turning now to the drawings and more particularly first to FIGS. 1 and 3, there are shown storm drain systems 10. The systems are installed in chamber 12 in accord with one possible embodiment of the present invention. As used herein a chamber may comprise any storm water intake, generally at ground elevation, in which an opening 14 opens into a receptacle 12 in fluid communication with a subsurface storm sewer drainage system of conduits 16. The chamber 12 has at least one wall 13, and may be regular or irregular in shape and surface and vertically or horizontally disposed, for example, it may be columnar or polygonal or more complex in vertical or horizontal cross section. In FIGS. 1, 3–6, chamber 12 has six sides, each parallel to the opposite side, one side of which is not closed and is an opening 14. Chamber 12 connects into main and/or branch conduits 16 as indicated in FIGS. 1, 3–6. Chamber 12, in vertical or horizontal cross section and dimension (in FIGS. 1, 3–6, vertical cross section and dimension), may comprise a volume that is substantially larger or smaller in size than opening 14 above it (in FIGS. 1, 3–6, larger in vertical dimension). Opening 14 preferably comprises an inlet 15 sized and shaped to prevent large objects from being swept into the chanber and the storm sewer conduits, and suitably is a grating 15 or other multi-aperture intake that prevents objects larger than the apertures from entering chamber 12. Chambers 12 situated alongside streets or in parking lots or other sites where vehicular traffic occurs are preferably weigh bearing to support such traffic. Chamber 12 typically may be defined or formed within concrete walls 13. Opening 14 and inlet 15 may have dimensions of several feet by several feet, e.g. 30 inches by 36 inches, 31 inches by 21 inches, 32 inches by 24 inches, and larger and smaller, by plus or minus several feet. In some cases, openings 14 and gratings 15 are of standard sizes and commonly utilized throughout a storm system.

FIG. 1 and FIG. 2 show embodiments of a buoyant door assembly 18 secured to support frame 20. Support frame 20 may be mounted along a generally vertical oriented flow passageway (indicated by arrow 22) in chamber 12. Vertically oriented flow passageway 22 may connect between surface 26 to storm water conduits 16 (see FIGS. 1 and 3–6) such as drains, mains, or branches therefrom. In the embodiments of FIGS. 1 and 3, support frame 20 is shown surrounding generally vertically oriented flow path 22 but in other embodiments support frame 20 might possibly be positioned only on one or more sides of flow path 22. In the shown embodiments, support frame 20 is securely mounted below adjacent surface 26 (for example, suitably about 12 inches below grate 15 in a 48 inch tall chamber) utilizing anchors 28 which may be cemented into position in the wall 13 surrounding the opening 14 leading to chamber 12 through grating inlet 15. Anchors 28 may be of various suitable types and be provided in suitable numbers as desired as may depend on the size of support frame 20 and the anticipated forces acting thereon. Hilte type anchors are suitable.

Support frame 20 may also be located at a lower position in vertical flow path 22 if desired and may be provided at a selected distance from surface 26 as deemed most desirable, e.g. as a non-limiting example support frame 20 could be mounted within one to three feet from surface 26 with the distance selected based the level of water in the chamber at which it would be desirable to prevent flow upward therethrough for a particular area surrounding the storm water drain or storm water drains which may comprise storm water drain system 10.

Support frame 20 may be comprised of steel, and, as depicted in FIG. 1, may be separate from an upper frame 21, which may provide a seat 34 that surrounds fluid flow passageway 36 through seat 34. Seat 34 is discussed hereinafter. In the embodiments shown in FIGS. 2–6, support frame 20 is unitary with an upper frame portion 21 to comprise a sturdy H-frame construction 23 as viewed in the cross-section thereof shown in FIGS. 2, 4, 5 and 6.

In one possible embodiment of the present invention, upper support frame 21 or unitary H-frame 23 may also provide a seat(s) or opening(s) adapted to receive and support one or more various types of a storm water inlet 15. Support frame 21 or 23 may also utilize one or more flanges or braces 32 to support seat 34 which surrounds fluid flow passageway 36 through seat 34, discussed hereinafter. In the case where the chamber volume is much larger than flow path 22 or inlet 14, support frame 21 or 23 may not contact lower chamber walls at larger regions in chamber 12 but instead be supported by upper surface walls which lead into chamber 12.

Figure 5:
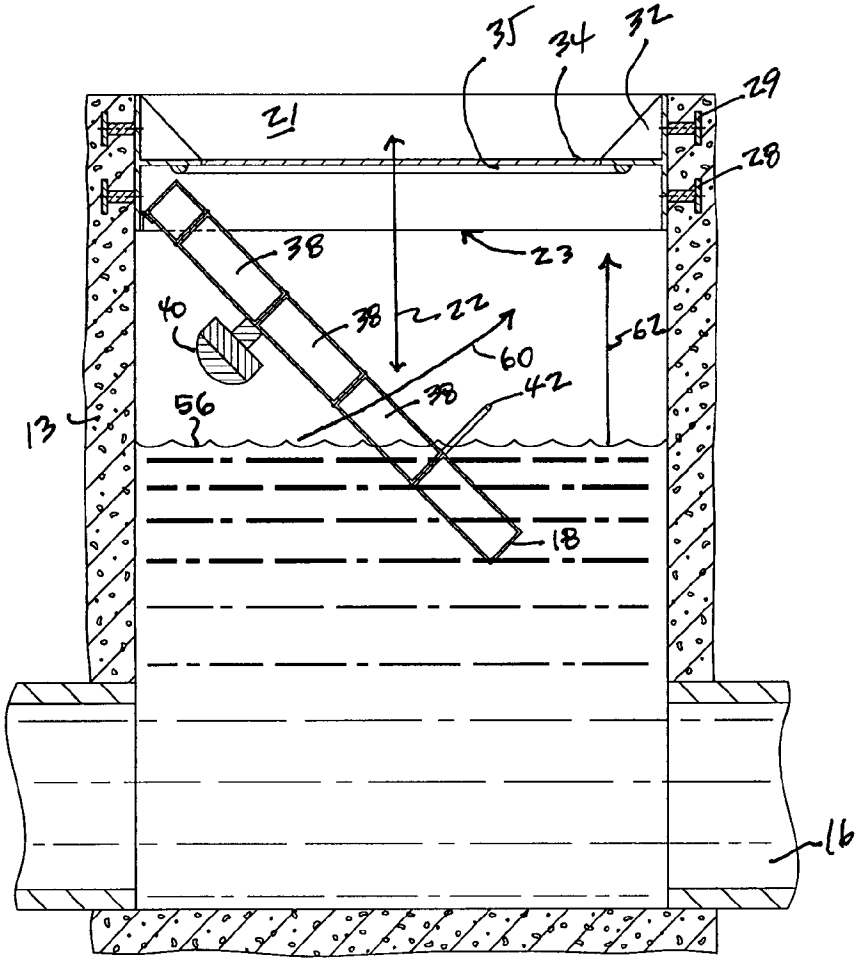
FIG. 5 is an elevational view of a storm drain system with the buoyant door assembly of FIG. 4 responding to rising flood water in accord with one possible embodiment of the invention.

In the views of FIG. 1–FIG. 6, buoyant door assembly 18 is shown pivotally connected by means of pivoting connectors 30 such as hinges or the like, and more generally by any type of joint that holds support frame 20 or 23 and buoyant door assembly 18 together so that buoyant door assembly 18 can swing relative to the support frame 20 or 23. If desired, a frame (not shown) separate from support frame 20 or 23 or other frames could be provided to support buoyant door assembly 20 although in one embodiment of the present invention support frame 23 conveniently may support all major components of storm water drain system 10 such as buoyant door assembly 18, inlet 16, and seat 34 into which buoyant door assembly 18 is urged into seating engagement by rising water, as indicated in FIG. 5. While a pivotal interconnection to permit pivotal movement of buoyant door assembly 18 is a preferred embodiment, other constructions could also be utilized that provide movement of buoyant door assembly 18 on rise and fall of water within chamber 12 respectively to provide for seating engagement and disengagement. For instance, buoyant door assembly 18 could be mounted with guides (not shown) or within a suitable guide frame (not shown) which holds buoyant door assembly 18 in a substantially horizontal position so as to be slidable vertically upwardly and downwardly to thereby substantially engage generally horizontally oriented seat 34 in response to rising flood waters. Moreover, while buoyant door assembly 18 is shown in this embodiment to be rectilinear in shape, buoyant door assembly 18 may be round or any other shape as desired relative to a configuration for the door frame that would provide a seating surface. Buoyant door assembly 18 may be comprised of steel, steel plates (for non-limiting example, steel plating ¼ inch thick), composite materials, combinations of the above, or other suitable materials, and may comprise braces, internal beams or the like, as desired.

In a preferred embodiment, buoyant door assembly 18 comprises sealed air or foam or honeycomb sections or compartments 38 defined therein. Compartments 38 are sufficiently large and sealed or preferably filled with materials such as foam plastic or the like so that, when water rises within chamber 12, buoyant door assembly 18 will float upwardly due to the buoyant force acting on buoyant door assembly 18. If desired, external float elements could also be mounted to buoyant door assembly 18. Alternatively, separate float elements may be mounted on frames or within guides designed so that when the float elements float upwardly they directly engage and/or interact with pulleys, gears, chains, or the like to operate door assembly 18.

If desired, buoyant door assembly 18 may comprise door bumper or stop 40 which limits downward travel of buoyant door assembly 18. Stop 40 may be comprised of suitable material which does not damage the walls of chamber 12. Stop 40 may be of any desired shape or size and may or may not be utilized, as desired. As well, one or more lifting lug and/or latches 42 may be provided on buoyant door assembly 18. Lifting lug or latch 42 may comprise suitable connectors to help lift the assembly into position. As well, if desired for any reason, lifting lug or latch may be utilized to latch buoyant door assembly 18 in a closed position such as by using cable, or rods, or the like (not shown).

Figure 6:
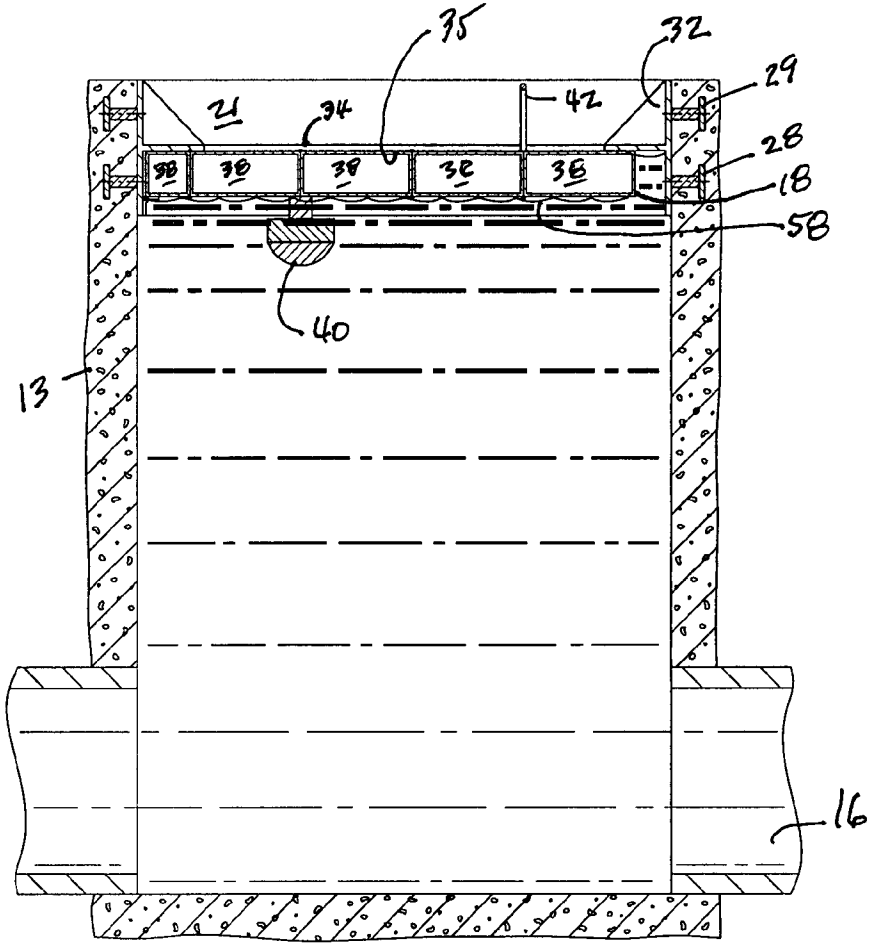
FIG. 6 is an elevational view of a storm drain system with a buoyant door assembly of FIG. 3 engaging compression seals to prevent flow out of the storm chamber drain in accord with one possible embodiment of the invention.

Seat 34 may preferably be mounted horizontally or substantially horizontally on or integral with support frame 20 or 23 and may preferably comprise compression gasket seal 35 or any other suitable type of seal in surrounding relationship with fluid flow passageway 36 through seat 34. Seat 34 may be integral with support frame 20 or 23 or be a separate component or assembly mounted thereto. The seal for seat 34 should be of a type that provides good sealing when buoyant door assembly 18 is urged against seat 34 as indicated in FIG. 6. While in the embodiment of FIG. 2, seal 35 is positioned on a lower side of seat 34, compression sealing elements could also be provided on a top surface of buoyant door assembly 18 and/or be provided on the outer edges of buoyant door assembly 18 and/or be provided on vertical surfaces surrounding seat 34.

While the present invention conveniently provides an all-in-one support frame assembly to permit simultaneous installation of storm system 10, buoyant door assembly 18 and seat 34 may also comprise separate components which could be anchored within chamber 12 as desired either during construction of the chamber or after the chamber has already been installed.

In operation of storm system 10, buoyant door assembly 18 is normally open when flood water as indicated at 54 is low or absent. As flood waters begin to rise as indicated by level 56 and arrow of water rise 62 in FIG. 5, then buoyant door assembly 18 moves or floats in the flood water upwardly as indicated by arrow 60 toward seat 34. If water continues to rise in chamber 12 as indicated at water level 58, then buoyant door assembly 18 completely closes and seals flow passageway 22 to prevent upward flow of water out of chamber 12. In this manner, storm system 10 prevents, delays, or limits flooding caused by rising water.

In yet another possible embodiment of the present invention, one or more position sensors which sense a position of buoyant door assembly 18 may be utilized. For instance, position sensors may be mounted at position 44 around seat 34 to indicate when buoyant door assembly 18 has closed. Alternatively, or in addition, one or more sensors may be utilized at position 46 as a non-limiting example to indicate that the buoyant door assembly is completely open. Alternatively, or in addition, tilt sensors, or the like, may be utilized at some convenient position, e.g. position 48 on buoyant door assembly 18, to indicate a level or more precise position of buoyant door assembly 18 so as to provide a level of the water within chamber 12. The sensors may then connect through wire 52 or wireless or other communication system means to various elements 50 as may be advantageous for utilizing information about rising water in chamber 12. Alternatively or in addition, a flag or sign (not shown) on a flexible pole (not shown) could be mounted therein which would be vertically lifted through inlet 16 as bouyant door assembly moves upwardly to provide a manual visual indication of the flood status which could be viewed from a distance and/or to provide a warning to motorists on a road containing storm drains 10. Element 50 may represent any of many of devices which might advantageously use or display such information such as signs, displays, or moveable street barriers such as arms which operate in response to flood information. For instance, element 50 may comprise a display at a central flood command center. Element 50 may also comprise an automatic arm or flashing signal to block or warn automobile traffic from entering a street, underpass, or area where flooding may be imminent as indicated by a shut door assembly.

The drawings are intended to describe the concepts of the invention so that the presently preferred embodiments of the invention will be plainly disclosed to one of skill in the art, but the drawings are not intended to be renditions of finalized product designs and may include simplified conceptual views as desired for easier and quicker understanding or explanation of the invention. It will be seen that various changes and alternatives may be used that are contained within the spirit of the invention. Moreover, it will be understood that various directions such as "upper," "lower," "bottom," "top," "left," "right," "inwardly," "outwardly," and so forth are made only with respect to easier explanation in conjunction with the drawings and that the components may be oriented differently, for instance, during transportation and manufacturing as well as operation. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

I claim:

1. A storm drain system to prevent upward flow through a storm drain inlet due to rising water, said storm drain inlet opening into a chamber into which water ordinarily drains through said storm drain inlet, said chamber comprising one or more walls, said system comprising:

a seat horizontally mounted or substantially horizontally mounted within said chamber around a substantially vertically oriented flow passageway through said chamber leading to the surface and above the top of a drainage conduit ordinarily draining from said chamber water entering through said inlet; and a buoyant door assembly which floats in water, said buoyant door assembly being movably mounted with respect to said seat and being responsive to water rising in said chamber by floating relatively upwardly until said buoyant door assembly engages said seat, said buoyant door being of sufficient size to block said vertically oriented passageway and thereby prevent water entering said chamber from said drainage conduit from flowing upwardly out of said chamber through said storm drain inlet.

2. The storm drain system as claimed in claim 1 further comprising one or more pivotal mountings for said buoyant door assembly whereby said buoyant door assembly hangs downwardly normally and responds to said rising water by pivoting upwardly to engage said seat.

3. The storm drain system as claimed in claim 2 wherein said seat further comprises a compression gasket seal for sealing in response to engagement with said buoyant door assembly.

4. The storm drain system as claimed in claim 1 futher comprising a support frame mounted along said substantially vertically oriented flow passageway, said seat being integral with said support frame.

5. The storm drain system as claimed in claim 4 further comprising a plurality of mounting members for said support frame to secure said support frame to said one or more walls of said chamber.

6. The storm drain system as claimed in claim 4, said seat further comprising a gasket seal affixed with respect to said support frame for sealing in response to engagement with said buoyant door assembly.

7. The storm drain system as claimed in claim 4 wherein said buoyant door assembly is mounted to said support frame.

8. The storm drain system as claimed in claim 7 further comprising one or more pivot mountings to secure said buoyant door assembly pivotally with respect to said support frame.

9. The storm drain system as claimed in claim 4 wherein said storm drain inlet comprises a grating and said support frame provides a drain support on an upper end thereof to support said grating.

10. A storm drain system as claimed in claim 1 further comprising a stop element mounted to said buoyant door assembly to limit downward movement of said buoyant door assembly away from said seat in the absence of said rising water.

11. A storm drain system as claimed in claim 1 wherein said buoyant door assembly further comprises a plurality of lightweight compartments which produce a buoyant force to move said buoyant door assembly into engagement with said seat in response to said rising water.

12. A storm drain system as claimed in claim 1 further comprising one or more position sensors which sense a position of said buoyant door assembly.

13. A storm drain system as claimed in claim 12 further comprising a communication system for providing a signal with flood information concerning said position of said buoyant door assembly.

14. A storm drain system as claimed in claim 13 further comprising at least one sign or display or closure barrier which operates in response to said flood information.

15. A storm drain system to prevent upward flow due to rising water and thereby prevent or limit or delay flooding at a surface position, a chamber into which water drains from said surface position, said chamber comprising one or more walls, said system comprising:

a seat secured within said chamber above the top of a subsurface drainage conduit ordinarily draining from said chamber water entering from said surface position and defining a generally vertically oriented opening leading to said surface position; and a door assembly, said door assembly being movably mounted with respect to said seat; and float elements for said door assembly responsive to water rising in said chamber by floating relatively upwardly and for moving said door assembly until said door assembly engages said seat, whereby said door assembly obstructs water flowing into said chamber from said drainage conduit from flowing upwardly toward said surface position through said generally vertically oriented opening.

16. The storm drain system as claimed in claim 15 further comprising one or more pivotal mountings for said door assembly whereby said buoyant door assembly hangs downwardly normally and responds to said rising water by pivoting upwardly to engage said seat.

17. The storm drain system as claimed in claim 16 wherein said seat further comprises a compression gasket seal for sealing in response to engagement with said door assembly.

18. The storm drain system as claimed in claim 16 futher comprising a support frame mounted along said generally vertically oriented opening leading to said surface position, said seat being affixed to or integral with said support frame.

19. The storm drain system as claimed in claim 18 further comprising a plurality of mounting members for said support frame to secure said support frame to said one or more walls of said chamber.

20. The storm drain system as claimed in claim 18 wherein said door assembly is mounted to said support frame.

21. The storm drain system as claimed in claim 20 further comprising one or more pivot mountings to secure said door assembly pivotally with respect to said support frame.

22. The storm drain system as claimed in claim 18 further comprising a storm inlet grating, and a drain support on an upper end of said support frame to support said storm drain inlet grating.

23. The storm drain system as claimed in claim 16, further comprising a seal positioned between said seat and said door assembly.

24. A storm drain system as claimed in claim 15 further comprising one or more position sensors which sense a position of said buoyant door assembly and thereby sense a level of water within said chamber.

25. A storm drain system as claimed in claim 24 further comprising a communication system for transmitting flood information concerning said position of said door assembly and said level of water with said chamber.

26. A storm drain system as claimed in claim 15 further comprising at least one sign or display or closure barrier which operates in response to movement of said buoyant door assembly.

27. A storm drain system as claimed in claim 15 wherein said door assembly further comprises a plurality of compartments comprising low density material or air, said plurality of compartments being sized to produce a buoyant force sufficient to move said door assembly into engagement with said seat in response to said rising water.

28. A storm drain system as claimed in claim 15 further comprising a stop element mounted to said door assembly to limit downward movement of said door assembly away from said seat in the absence of said rising water.

29. A storm drain valve assembly, comprising:

a support frame for horizontally or substantially horizontally mounting along a substantially vertically oriented storm drain passageway above the top of a drainage conduit for said passageway, a seat integral with said support frame; and a buoyant door assembly which floats in water, said buoyant door assembly being movably mounted with respect to said seat and being responsive to water rising in said passageway by floating relatively upwardly until said buoyant door assembly engages said seat, said buoyant door being of sufficient size to block said vertically oriented passageway and thereby prevent water flowing upwardly past said door assembly.

30. The valve assembly of claim 29, further comprising one or more pivotal mountings for said buoyant door assembly whereby said buoyant door assembly hangs downwardly normally and responds to rising water by pivoting upwardly to engage said seat.

31. The valve assembly as claimed in claim 29 further comprising a plurality of mounting members for said support frame to secure said support frame to one or more walls of said passageway.

32. The valve assembly as claimed in claim 29, said seat further comprising a gasket seal affixed with respect to said support frame for sealing in response to engagement with said buoyant door assembly.

33. The valve assembly as claimed in claim 29 wherein said buoyant door assembly is mounted to said support frame.

34. The valve assembly as claimed in claim 33 further comprising one or more pivot mountings to secure said buoyant door pivotally with respect to said support frame.

35. A valve assembly as claimed in claim 29 further comprising a stop element mounted to said buoyant door to limit downward movement of said buoyant door assembly away from said seat in the absence of said rising water.

36. A valve assembly as claimed in claim 29 wherein said buoyant door comprises a plurality of lightweight compartments which produce a buoyant force to move said buoyant door into engagement with said seat in response to said rising water.

37. The valve assembly as claimed in claim 34, said seat further comprising a gasket seal affixed with respect to said support frame for sealing in response to engagement with said buoyant door assembly, said valve assembly further comprising a plurality of mounting members for said support frame to secure said support frame to one or more walls of said passageway.

38. The valve assembly of claim 37 wherein said buoyant door comprises a plurality of lightweight compartments which produce a buoyant force to move said buoyant door into engagement with said seat in response to said rising water and further comprising a stop element mounted to said buoyant door to limit downward movement of said buoyant door assembly away from said seat in the absence of said rising water.

39. A method for preventing flooding due to rising water which flows upwardly and out of chambers which connect to a storm drain system, comprising:

providing one or more sealing elements around a vertically oriented conduit through said chamber which leads to a surface position and above the top of a drainage conduit connecting to a storm drain system an ordinarily draining water from said chamber;

providing a moveable door which in an open position permits drainage from said surface position into said chamber and in an closed position is engageable with said one or more sealing elements to thereby obstruct said rising water entering said chamber from said drain system from flowing through said vertically oriented conduit through said chamber; and providing one or more floatation elements positioned to operate said moveable door such that said door is in said open position when a water level in said chamber is sufficiently low and is in said closed position when water level in said chamber is sufficiently high.

40. The method of claim 39, further comprising providing that said floatation elements are formed within said door.

41. The method of claim 39, further comprising providing a support frame for supporting said one or more sealing elements and for hingeably supporting said moveable door.

42. The method of claim 41, further comprising providing a seat integral with said support frame to engage said door.

43. The method of claim 42, further comprising providing said seat with a compression seal element sized to seal around said vertically oriented conduit.

44. The method of claim 41, further comprising providing a storm inlet grating which mounts to an upper side of said support frame.

* * * * *